United States Patent [19]

Bouma

[11] 3,934,381

[45] Jan. 27, 1976

[54] STOP LOCK ASSEMBLY FOR A PIVOTAL TOWER

[75] Inventor: Ype Bouma, Exmorra, Netherlands

[73] Assignee: General Crane Industries Limited, London, Canada

[22] Filed: Apr. 22, 1974

[21] Appl. No.: 462,941

[30] Foreign Application Priority Data

June 5, 1973 Canada ..... 173260

[52] U.S. Cl. ..... 52/116; 52/115

[51] Int. Cl.[2] ..... E04H 12/34

[58] Field of Search ..... 52/116–120, 52/115; 173/43, 28; 254/139.1; 182/68, 127

[56] References Cited

UNITED STATES PATENTS

| | | | |
|---|---|---|---|
| 2,193,293 | 3/1940 | Nichols | 173/28 X |
| 2,327,461 | 8/1943 | Rowe | 52/116 X |
| 2,354,922 | 8/1944 | McEwen et al. | 52/119 X |
| 2,611,580 | 9/1952 | Troche et al. | 254/139.1 |
| 2,711,803 | 6/1955 | Hurst | 254/139.1 X |
| 2,790,622 | 4/1957 | Priest | 52/119 X |
| 2,993,570 | 7/1961 | Bender | 52/118 |
| 3,015,374 | 1/1962 | Carbert et al. | 52/119 X |
| 3,101,816 | 8/1963 | Fox | 52/118 |
| 3,109,523 | 11/1963 | Moller | 52/119 X |
| 3,189,134 | 6/1965 | Womack et al. | 52/116 X |
| 3,778,940 | 12/1973 | Blechen | 52/116 |

*Primary Examiner*—Ernest R Purser
*Assistant Examiner*—Leslie A. Braun
*Attorney, Agent, or Firm*—Brady, O'Boyle & Gates

[57] ABSTRACT

A stop lock assembly for a tower mounted on a platform and pivoted thereon whereby the tower is adapted to be raised from a horizontal position to a vertical, erected position. Stop members are operatively connected between the platform and the tower to limit the pivotal movement of the tower to the erected position and to hold portions of the platform and tower in alignment for the reception of locking pins extending therebetween for holding the tower in the erected position.

5 Claims, 10 Drawing Figures

FIG. 2
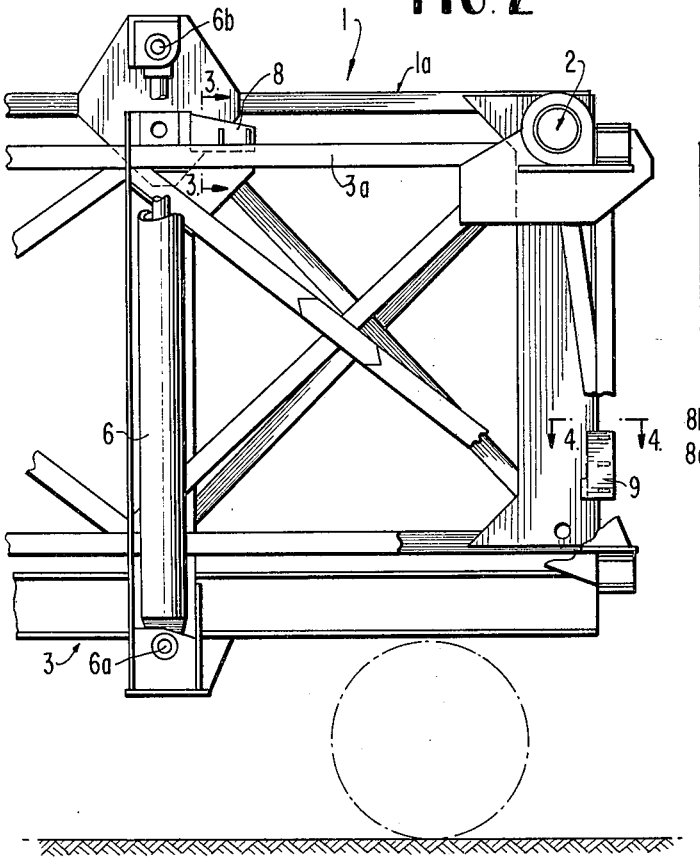
FIG. 3
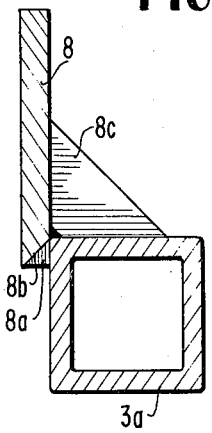
FIG. 1
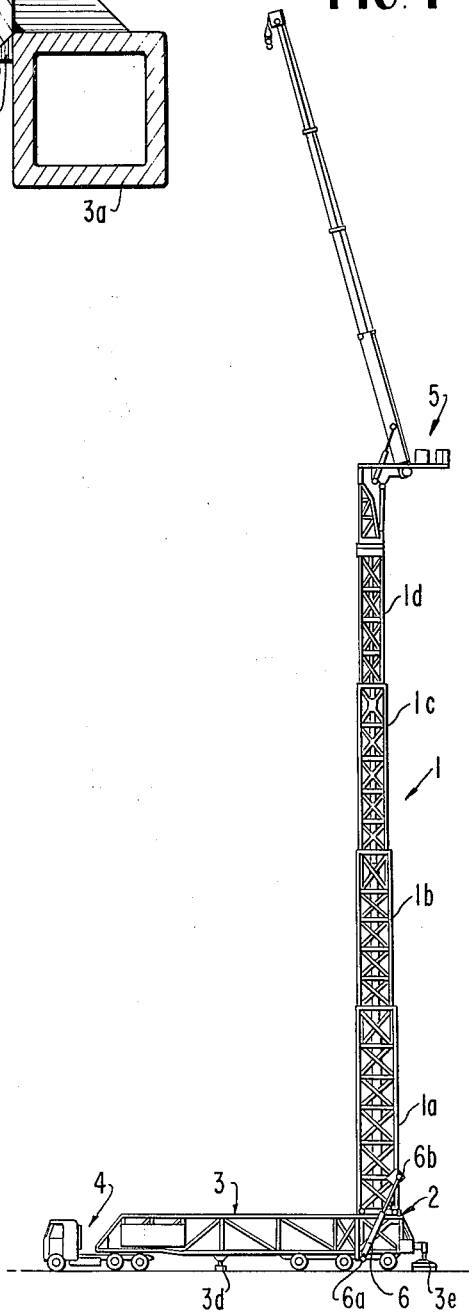
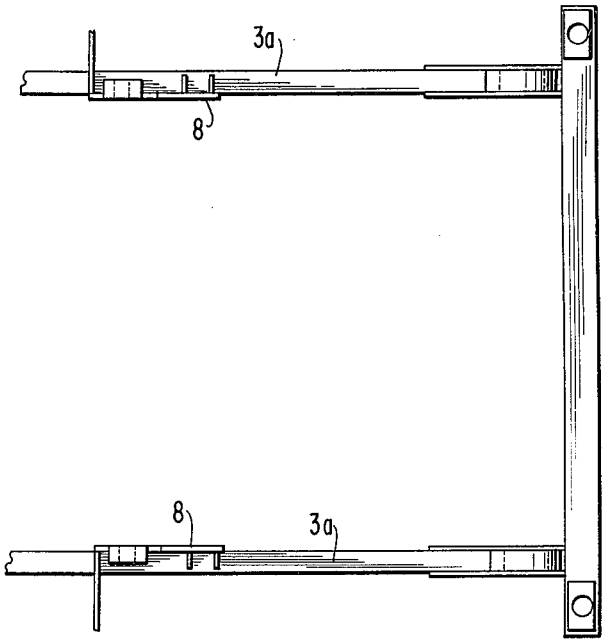
FIG. 5

FIG. 4
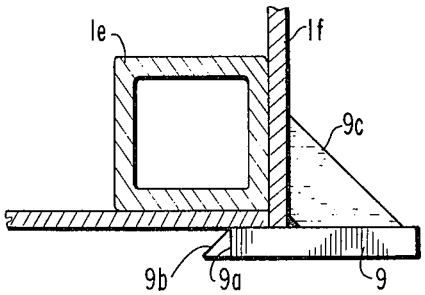
FIG. 7
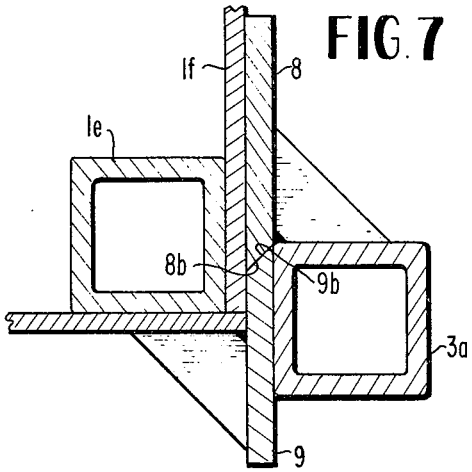
FIG. 8
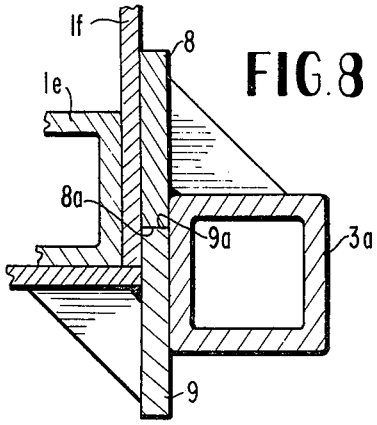
FIG. 6
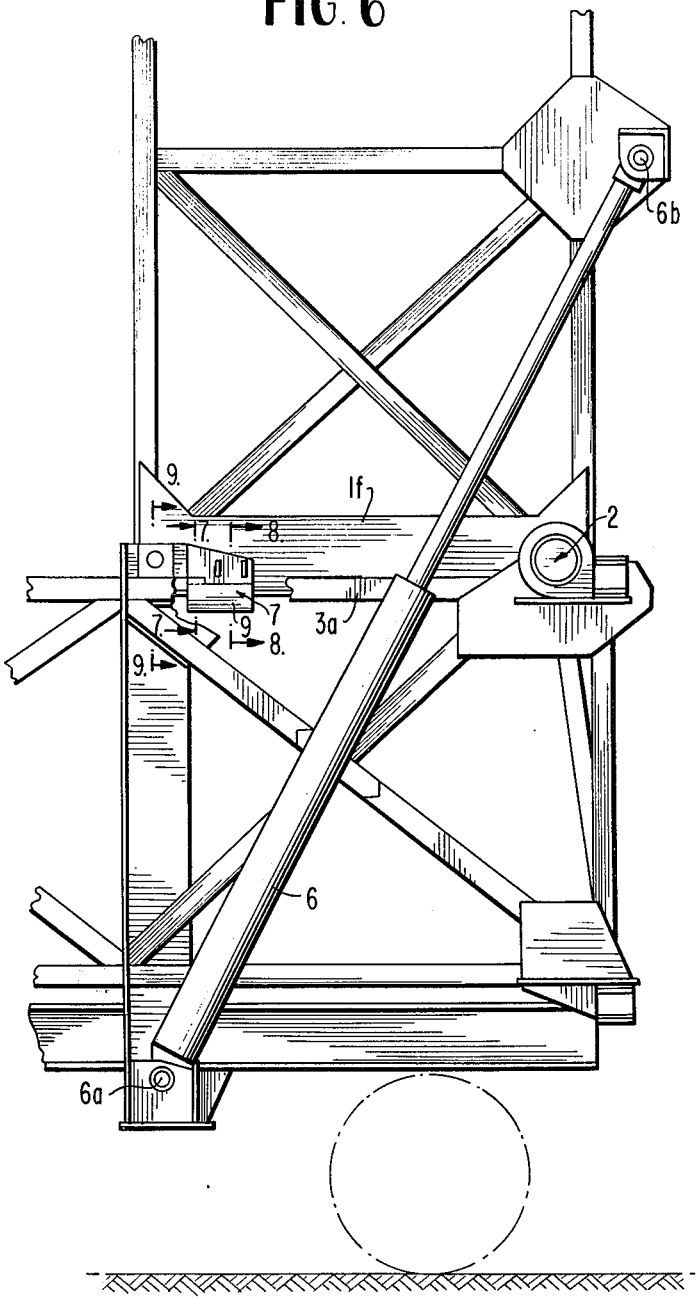
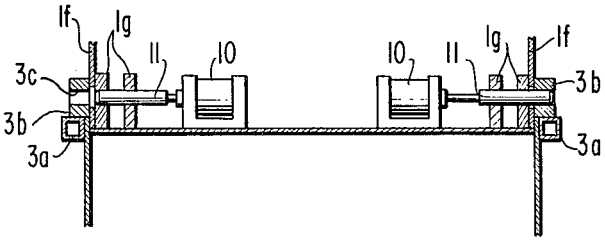
FIG. 9
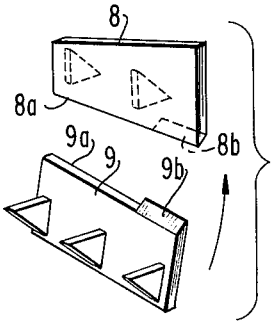
FIG. 10

STOP LOCK ASSEMBLY FOR A PIVOTAL TOWER

The present invention relates to a stop lock assembly for a tiltable tower mounted on a platform and tiltable between a vertical operating position and a substantially horizontal stored position, the stop lock assembly being constructed and arranged to limit the pivotal movement of the tower to the vertical operating position, and to hold portions of the platform and tower in alignment for the reception of locking pins therebetween.

In mobile tower assemblies, it is conventional to pivotally connect the tower to a mobile support structure, whereby the tower is tiltable on the support structure from a substantially horizontal travelling position to a vertical operating position, and the tower is usually held in the vertical operating position by transversely extending pins insertable between the tower and the support structure. In order to limit the pivotal movement of the tower to the vertical operating position, it is necessary to provide stop members to arrest the pivotal movement prior to the insertion of the locking pins. After considerable research and experimentation, the stop lock assembly of the present invention has been devised which not only limits the pivotal movement of the tower to the vertical operating position but also holds portions of the tower and support structure in alignment to facilitate the insertion of the pins.

The stop lock assembly of the present invention comprises, essentially, a pair of plate members connected, respectively, to the sides of the tiltable tower and support structure, the plate members having surfaces adapted to interengage when the tower is pivoted to the vertical operating position whereby the pivotal movement of the tower is arrested, and portions of the adjacent sides of the supporting structure and tower are pulled transversely toward each other to facilitate the insertion of the locking pins therein.

The invention will further be described by way of example with reference to the accompanying drawings in which:

FIG. 1 is a side elevation of a mobile tower assembly in the vertical operating position;

FIG. 2 is a fragmentary, side elevational view of the support structure and tower in the stored or travelling position;

FIG. 3 is a sectional view along line 3—3 of FIG. 2;

FIG. 4 is a sectional view along line 4—4 of FIG. 2;

FIG. 5 is a fragmentary top plan view of the support structure with the tower removed therefrom;

FIG. 6 is a fragmentary side elevational view of the support structure and tower in the vertical operating position;

FIG. 7 is a sectional view taken along line 7—7 of FIG. 6;

FIG. 8 is a sectional view taken along line 8—8 of FIG. 6;

FIG. 9 is a sectional view taken along line 9—9 of FIG. 6; and

FIG. 10 is a perspective view of the plate members employed in the stop lock assembly of the present invention.

Referring to the drawings and more particularly to FIG. 1 thereof, the stop lock assembly of the present invention is adapted to be employed in a mobile tower arrangement wherein a tower 1 is pivotally connected as at 2 to a support structure 3. For purposes of illustration, the support structure forms part of semi-trailer vehicle 4, and the tower supports a telescopic crane assembly 5 on the upper end thereof. The tower includes a plurality of telescoping sections including a base section 1*a* and upper sections 1*b*, 1*c* and 1*d*, and when these are telescopically collapsed into the base section, the base section 1*a* can be moved from the vertical position to the horizontal travelling position, as shown in FIG. 2, by hydraulic rams 6 positioned on each side of the support structure and each having one end connected to the support structure as at 6*a* and the opposite end connected to the tower as at 6*b*.

The tower and support structure are each of lattice type construction including tubular frame members 1*e* and 3*a*, respectively, upon which a stop assembly 7 (FIG. 6) is mounted on each side thereof.

The details of the stop assembly are shown in FIG. 10 wherein a pair of plates 8 and 9 are each provided with machined surfaces 8*a*, 8*b*, 9*a* and 9*b* which are adapted to interengage when the tower is pivoted to the erected position, to be described more fully hereinafter.

As will be seen in FIG. 3, the plate 8 is rigidly secured to the tubular frame member 3*a* by gusset plates 8*c*; and as will be seen in FIG. 4, the tubular frame 1*e* carries a side plate 1*f* to which plate 9 is rigidly secured through gusset plates 9*c*.

Referring to FIG. 9, the base of the tower is provided with a pair of hydraulic cylinders 10 each of which is connected to a transversely extending locking pin 11 slidable within bores formed in the side plates 1*f* and associated plates 1*g* spaced inwardly from plates 1*f*, the bores being coaxial with respect to each other and parallel to the longitudinal axis of the tower pivot 2. The tubular frame members 3*a* of the support structure are also provided with side plates 3*b* having bores 3*c* formed therein which, when aligned with the bores in side plates 1*f*, receive the locking pins 11, whereby the tower is locked in the vertical position.

In operation, when the tower is pivoted from the horizontal, stored position, as shown in FIG. 2, to the vertical operative position, as shown in FIG. 6, by means of the hydraulic rams 6, the machined surfaces 8*a*, 9*a*, and 8*b*, 9*b* of plates 8 and 9 become interengaged as shown in FIGS. 7 and 8. By the construction and arrangement of the interengaged plates 8 and 9, the flat surfaces 8*a* and 9*a* function as stops to limit the pivotal movement of the tower base section 1*a* to the vertical position, wherein the bores in the side plates 1*f* and 3*b* are aligned for the reception of the locking pins 11. The interengagement of the tapered surfaces 8*b* and 9*b* produces a force tending to pull the support structure side plates 3*b* inwardly against an outwardly bending force produced by the outward movement of the locking pins through the bores in the tower side plates 1*f* and support structure side plates 3*b*, whereby the bores through which the pins extend are maintained in alignment for the reception of the pins therein.

While the stop lock assembly of the present invention has been described for use in a mobile tower crane arrangement, it will be appreciated by those skilled in the art that the assembly can be employed equally as well in other erectable structures wherein a tower is pivotally connected to a platform or other support structure and wherein transversely extending pivot pins are employed for maintaining the tower in the erected position.

In the pivotal tower of the present invention, the support structure 3 is provided with front and rear outriggers 3*d* and 3*e*, respectively, which support the tower arrangement when it is required to remove the tractor. The location of the front outriggers 3*d* enhances the support of the tower to facilitate 360° rotation of all crane functions wherein torsional and/or racking forces are transmitted to the tower and its support structure. The most desirable structure for the transfer of these torsional and/or racking forces is a box structure; accordingly, the lower support structure 3 is fabricated to provide an opened-top U-shape construction, the box structure being formed when the base of the tower is swung upward into position. As the tower base approaches its limit of travel, the stop assemblies secure the sides of the U to the base of the tower at which time the locking pins are actuated horizontally to prevent the tower base from moving down and away from the secured position and to retain the box structure support configuration.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

The embodiments of the invention in which an exclusive property or privilege is claimed are defined as follows:

1. In an erectable tower assembly wherein the base of the tower is pivotally connected to a support structure including a pair of vertically positioned laterally spaced side members, said tower base adapted to be raised from a substantially horizontal stored position within substantially the vertical height of the side members wherein the tower base is disposed horizontally therebetween to a vertical operative position, and having transversely extending pins inserted in aligned bores in the tower and support structure for holding the tower in the erected position, the improvement comprising, stop means operatively connected between the support structure side members and the base of the tower operative to limit the pivotal movement of the tower to the operative position and operative to pull portions of the side members of the support structure laterally toward and into the overlying contact with the sides of the tower and against an outwardly bending force on the side members to maintain the bores in alignment for the reception of the locking pins therein.

2. In a tower assembly according to claim 1, wherein the stop means comprises a pair of plates, each plate having surfaces adapted to interengage when the tower is pivoted to the vertical position, one of the plates being secured to the support structure and the other plate being connected to the side tower.

3. In a tower assembly according to claim 2, wherein a pair of plates are provided on each side of the tower and support structure.

4. In a tower assembly according to claim 2, wherein the surfaces on each plate comprise a flat portion and a tapered portion, the flat portions for limiting the pivotal movement of the tower and the tapered portions for pulling portions of the support structure side members toward and in overlying contact with the sides of the tower.

5. In a tower assembly according to claim 4, wherein the plates are of rectangular configuration, are disposed in the same vertical plane, and the interengaging surfaces are formed on longitudinal edges of the plates.

* * * * *